United States Patent [19]

Lohnherr

[11] 4,402,462

[45] Sep. 6, 1983

[54] PROCESS FOR CONTROLLING A GRINDING INSTALLATION

[75] Inventor: Ludger Lohnherr, Oelde-Sunninghausen, Fed. Rep. of Germany

[73] Assignee: Krupp Polysius AG, Beckum, Fed. Rep. of Germany

[21] Appl. No.: 270,269

[22] Filed: Jun. 4, 1981

[30] Foreign Application Priority Data

Jun. 26, 1980 [DE] Fed. Rep. of Germany ..... 3024021

[51] Int. Cl.[3] ..... B02C 25/00

[52] U.S. Cl. ..... 241/30; 241/34; 241/37

[58] Field of Search ..... 241/30, 33, 34, 36, 241/37, 63, 109

[56] References Cited

U.S. PATENT DOCUMENTS

| | | | |
|---|---|---|---|
| 3,568,939 | 3/1971 | Brewster et al. | 241/30 X |
| 3,995,819 | 12/1976 | Kunogi et al. | 241/34 X |
| 4,172,515 | 10/1979 | Wochnowski | 241/36 X |
| 4,212,429 | 7/1980 | Cuvelier et al. | 241/30 X |

FOREIGN PATENT DOCUMENTS

| | | | |
|---|---|---|---|
| 620273 | 8/1978 | U.S.S.R. | 241/30 |

*Primary Examiner*—Howard N. Goldberg
*Attorney, Agent, or Firm*—Learman & McCulloch

[57] ABSTRACT

The invention relates to a process for regulating a grinding installation using four automatic control systems, of which one control system keeps the material level of the storage silo for the ground material constant by altering the grinding force of the roller mill. In this way, the mill throughput is altered in the event of variations in consumption in such a way that the differential mill pressure and hence the quality of the end product are kept constant.

6 Claims, 1 Drawing Figure

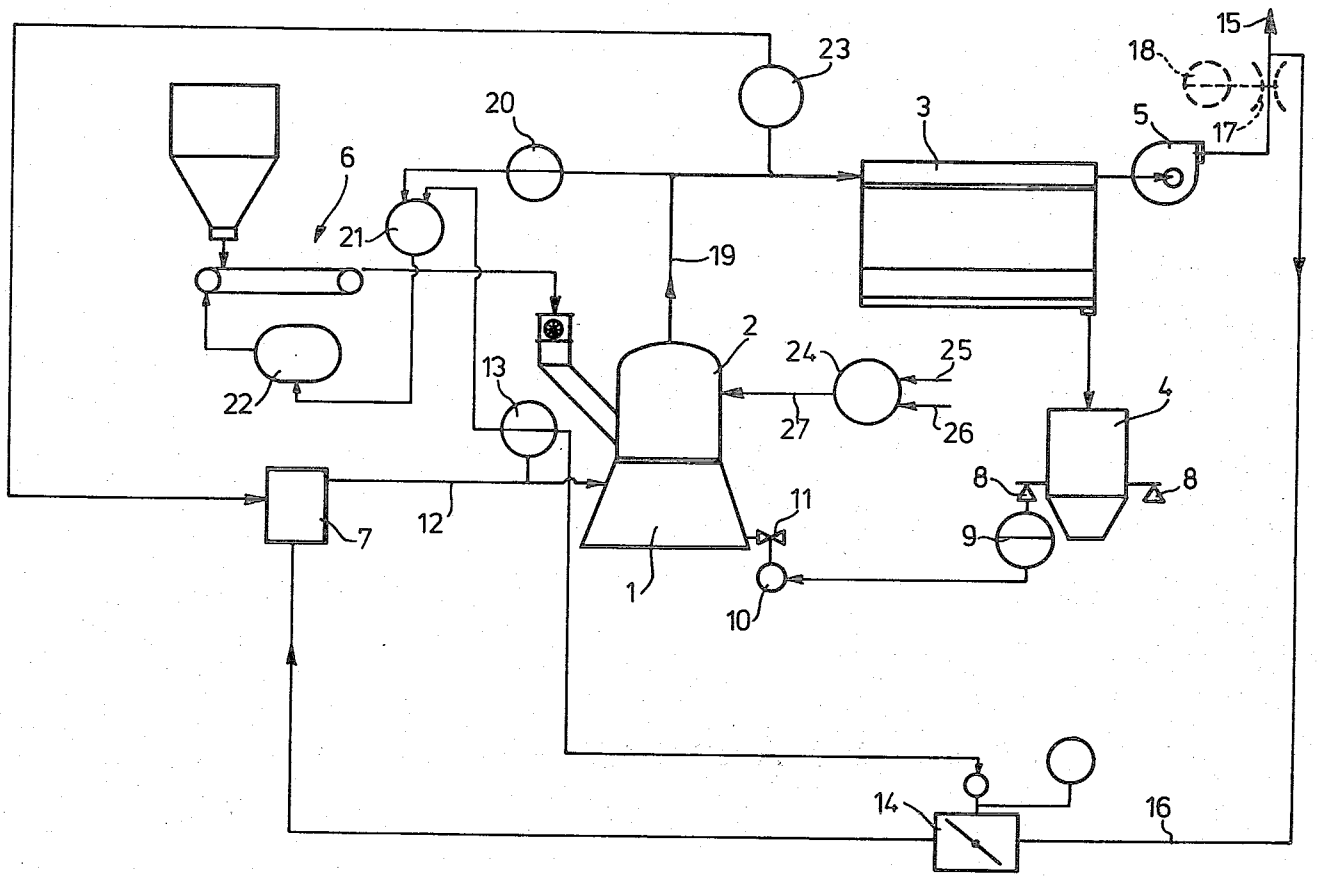
1
2
3
4
5
6
7
8
8
9
10
11
12
13
14
15
16
17
18
19
20
21
22
23
24
25
26
27

PROCESS FOR CONTROLLING A GRINDING INSTALLATION

BACKGROUND OF THE INVENTION

This invention relates to a process for controlling a grinding installation comprising a roller mill in which the grinding force is hydraulically generated and the ground material is pneumatically discharged, a separator, a recirculating air fan and a storage silo for the ground material, and wherein:

(a) the mill is operated under a negative gas pressure kept constant by a first automatic control system, (b) the differential pressure between the gas inlet end of the mill and the gas outlet end of the separator is kept constant by a second automatic control system which alters the amount of material delivered to the mill, and (c) the gas temperature prevailing at the gas outlet end of the separator is kept constant by a third automatic control system.

It is known that a grinding installation may be controlled by a process of the type described above. In this connection, the value known as the differential mill pressure (which is kept constant by the second automatic control system) is a measure of the amount of material in the grinding compartment of the mill and in the following gravity air separator. However, this second automatic control system is only effective if at the same time the amount of gas flowing through the mill and hence the gas velocity are kept constant. This is the responsibility of the first and third automatic control systems because the output of the fan depends upon the static pressure increase and upon the gas temperature for a constant rotational speed and a constant position of the guide apparatus.

This known process is based on the use of three automatic control systems and ensures constant mill operation for a certain mill throughput. Any variations in the amount of ground material required by the consumer have to be absorbed by the storage silo for the ground material (end product). On the one hand, this limits the permitted variations in consumption for a constant mill output and, in addition, gives rise to the further disadvantage that the storage silo for the end product may have to be operated for prolonged periods at a low filling level which, in the case of a storage silo for coal dust for example, is undesirable in the interests of explosion prevention.

SUMMARY OF THE INVENTION

The object of the present invention is to provide a control process of the general type mentioned above and wherein, in the event of variations in consumption, the mill throughput is varied in such a way that the differential mill pressure and hence the quality of the end product are kept constant.

According to the invention, this object is achieved in that the material level of the storage silo for the ground material is kept constant by a fourth automatic control system which varies the grinding force of the roller mill.

In the event of a reduction in consumption and hence an increase in the material level of the storage silo for the ground material (end product) beyond the prescribed level (which should be as near as possible to the highest possible level), the hydraulically generated grinding force of the roller mill is reduced. This in turn reduces the degree of grinding which leads to an increase in the internal circulation of material and hence to an increase in the differential mill pressure. The deviation in the differential mill pressure from the required value reduces the amount of material to be ground which is delivered to the mill until the differential mill pressure returns to its prescribed value.

By contrast, in the event of an increase in consumption, the reduced filling level of the storage silo for the ground material produces an increase in the hydraulically generated grinding force of the roller mill. This in turn produces an increase in the degree of grinding which leads to a reduction in the internal circulation of material and hence to a reduction in the differential mill pressure. In this case, the negative deviation of the differential mill pressure from its prescribed value increases the amount of material to be ground which is delivered to the mill until the differential mill pressure returns to its prescribed value.

Thus, irrespective of the particular consumption level, the control process according to the invention provides for a uniform, internal circulation of material between the mill and the separator for a substantially constant material level of the storage silo for the ground material, which has a favorable effect so far as keeping the fineness of the end product constant is concerned.

DESCRIPTION OF THE DRAWING

One example of an installation for carrying out the process according to the invention is illustrated in the accompanying diagrammatic drawing.

DETAILED DESCRIPTION

The installation comprises a roller mill 1 in which the grinding force is hydraulically generated and the ground material pneumatically discharged, a gravity air separator 2 arranged above the roller mill 1, a dust separator 3, a storage silo 4 for the ground product (end product), a recirculating air fan 5, a feed arrangement 6 for introducing the material, and a furnace 7 or other hot gas generator. Other parts of the installation will be explained in the description of its mode of operation.

The storage silo 4 rests on pressure gauges 8 which are connected to a controller 9 which acts through an electric motor 10 on a pressure-limiting valve 11 which is incorporated in the hydraulic circuit for generating the grinding force of the roller mill 1.

The negative pressure in the mill (and hence the quantity of recirculating air in the mill) may be kept constant in two different ways:

One possibility is to operate the mill recirculating air fan 5 at a constant rotational speed or fixed setting and to measure the negative pressure at the gas inlet end of the mill (pipe 12) by means of a pressure measuring element 13 and to keep it constant through a first automatic control system. This may be done through a control valve 14 in the return air pipe 16 leading from the chimney (pipe 15) to the furnace 7 or through a pressure valve (not shown) at the gas inlet end of the mill 1.

The other possibility of keeping the reduced pressure in the mill (and hence the amount of recirculating air in the mill) constant is to measure the amount of recirculating air by means of an orifice plate 17 and to control the recirculating air fan 5 in dependence upon the signal obtained through a controller 18 (first automatic control system).

The second automatic control system, which keeps the differential pressure between the gas inlet end (pipe 12) of the mill 1 and the gas outlet end (pipe 19) of the separator 2 constant, comprises the pressure measuring elements 13 and 20 connected to the pipes 12 and 19, a controller 21 which forms the differential pressure and which compares the actual signal with a prescribed value and a variable speed drive arrangement 22 controlled by the controller 21 for influencing the amount of material to be ground which is delivered to the mill 1.

The third automatic control system, by which the gas temperature at the gas outlet end (pipe 19) of the separator 2 is kept constant, comprises a temperature measuring element 23 which, in the embodiment illustrated, acts through a controller on the furnace 7. Alternatively, the gas temperature may also be kept constant by a control valve in a hot gas supply pipe.

The function of the fourth automatic control system provided in accordance with the invention is to keep the material level of the storage silo 4 for the ground material constant by varying the hydraulically generated grinding force of the roller mill 1. The signal coming from the pressure gauges 8 is delivered to the controller 9 which, in the event of a deviation from the prescribed value, varies the hydraulic pressure of the roller mill 1 through the pressure-limiting valve 11 shifted by the motor 10.

Finally, in the embodiment illustrated, there is a fifth automatic control system which keeps the fineness of the ground material constant by correspondingly adjusting the separator 2 (for example by adjusting the diffusion vanes of a static separator or the blades of a turbo-air separator). This fifth automatic control system comprises a controller 24 to which on the one hand a corresponding actual-value signal 25 and, on the other hand, a prescribed fineness signal 26 are delivered by an arrangement (not shown) which measures the fineness of the end product. The output signal 27 of this controller 24 is used for adjusting the separator 2.

The invention is further illustrated by the following example:

A cement kiln is operated at a daily output of 3000 t, the kiln burner consuming approximately 20 t/h of coal dust. For a mill output of 20 t/h, the hydraulic pressure used to generate the grinding force in the roller mill amounts to approximately 120 bar and the differential mill pressure to approximately 50 mbar.

If the kiln output is reduced to 2000 t/day, the kiln burner still requires approximately 13 t/h of coal dust. The reduction in the removal of coal dust from the storage silo results in an increase in the material level for the same mill output. This increase in the material level leads via a controller to a reduction in the hydraulic pressure or grinding force which results in poorer, i.e., coarser grinding and hence in an increase in the differential mill pressure. This in turn results in a reduction in the amount of material delivered to the mill. This compensating or controlling operation continues until the material level of the storage silo returns to the prescribed level and remains constant. The mill output then amounts to 13 t/h for a differential pressure of 50 mbar and a hydraulic pressure of the order of 80 bar.

I claim:

1. In a grinding process wherein material to be ground is delivered to an adjustable force grinding mill and ground, then classified pneumatically, and then conveyed pneumatically to a storage silo from which ground material may be withdrawn; the improvement comprising sensing variations in the quantity of ground material in said silo; and varying the force of said grinding mill inversely to the quantity of material contained in said silo to maintain the quantity of material in said silo substantially constant.

2. A process according to claim 1 wherein variations in the quantity of ground material in said silo are sensed by pressure gauges supporting said silo and which generate an electrical signal in response to a deviation from a predetermined value.

3. A process according to claim 5 wherein the grinding force of said mill is generated hydraulically and wherein the force of said grinding mill is varied by using said signal to adjust the hydraulic pressure to which said mill is subjected.

4. A process according to claim 1 including maintaining substantially constant the fineness of said ground material.

5. A process according to claim 1 including maintaining air pressure within said mill substantially constant.

6. A process according to claim 1 including maintaining said mill at a substantially constant negative air pressure.

* * * * *

UNITED STATES PATENT AND TRADEMARK OFFICE

CERTIFICATE OF CORRECTION

PATENT NO. : 4,402,462

DATED : September 6, 1983

INVENTOR(S) : Ludger Lohnherr

It is certified that error appears in the above-identified patent and that said Letters Patent are hereby corrected as shown below:

Column 4, line 34, claim 3, change "5" to -- 2 --.

Signed and Sealed this

*Fifteenth* Day of *November 1983*

[SEAL]

*Attest:*

GERALD J. MOSSINGHOFF

*Attesting Officer*

*Commissioner of Patents and Trademarks*